US005450658A

United States Patent [19]

Hicks

[11] Patent Number: 5,450,658

[45] Date of Patent: Sep. 19, 1995

[54] MAGNETIC SOCK HOLDER

[76] Inventor: Joel R. Hicks, 547 S. Indiana St., Anaheim, Calif. 92805

[21] Appl. No.: 177,942

[22] Filed: Jan. 6, 1994

[51] Int. Cl.[6] ..... A44B 21/00

[52] U.S. Cl. ..... 24/303; 24/DIG. 29

[58] Field of Search ..... 24/303, 49 M, DIG. 29; 248/206.5; 292/251.5; 335/285; 2/239

[56] References Cited

U.S. PATENT DOCUMENTS

| | | | |
|---|---|---|---|
| 2,663,877 | 12/1953 | Bohman | 2/239 |
| 3,041,743 | 7/1962 | Mousma | 24/DIG. 29 X |
| 3,254,440 | 6/1966 | Duggar | 24/303 X |
| 3,324,521 | 6/1967 | Humiston | 24/303 |
| 4,058,853 | 11/1977 | Boxer et al. | 2/239 |
| 4,265,002 | 5/1981 | Hosken | 24/303 |
| 5,021,021 | 6/1991 | Ballard | 335/285 X |
| 5,038,413 | 8/1991 | Ursino | 24/DIG. 29 X |
| 5,251,362 | 10/1993 | Riceman et al. | 24/303 |

FOREIGN PATENT DOCUMENTS

| | | | |
|---|---|---|---|
| 59-119803 | 7/1984 | Japan | 335/285 |

*Primary Examiner*—James R. Brittain

*Attorney, Agent, or Firm*—Stetina Brunda & Buyan

[57] ABSTRACT

An apparatus for reversibly securing a pair of socks together during handling and laundering. The apparatus comprises a combination of detachably interconnectable housing members, wherein each housing member is attached to a respective one of a pair of socks. By contacting the housing members to one another, a magnetic attraction and a non-sliding, interlocking engagement is created that holds the pair of socks together.

3 Claims, 1 Drawing Sheet

MAGNETIC SOCK HOLDER

FIELD OF THE INVENTION

The present invention relates to laundering devices, and more particularly, to devices for securing a pair of socks together during the laundering process.

BACKGROUND OF THE INVENTION

A well known problem associated with everyday laundering is the disarray that can occur with paired items of clothing such as socks. Through the laundering process, these matched pairs can become separated or lost, thus leaving the launderer with the unwanted task of having to match up the pairs of socks afterwards. Various attempts have been made to simplify this problem by using mechanical devices to keep the paired items together during the laundering process. One such attempt is illustrated by U.S. Pat. No. 2,663,877 to Bohman, wherein each sock of a pair of matching socks has snap fastening means to attach one sock to the other. Likewise, U.S. Pat. No. 4,058,853 to Boxer et al., discloses a pair of socks having a self-contained hook and loop fastener for securing each sock to one another.

However, these attempts have proven generally unsatisfactory. The fasteners that have thus far been used have the potential to interfere with the regular use of the apparel item. Furthermore, these fasteners may be unable to withstand the forces common to laundering and may cause the socks to slip or pull out of engagement during the washing process.

Accordingly, there is a need for an apparatus that can secure paired items of clothing in a connected state during the laundering process which also does not interfere with the normal intended use of the clothing items. In addition, there is a need for a fastening device that resists slipping or pulling out of engagement during the laundering process.

SUMMARY OF THE INVENTION

The present invention is directed to a magnetic sock holder that is useful for securing a pair of socks in connected condition during laundering and handling. The magnetic holder comprises a pair of detachably interconnectable housing members that, through means of an encapsulated magnet disposed therein, secure the paired socks together through ordinary handling and laundering procedures. Each housing member, which preferably comprises an exterior member and interior member, is attachable to a respective one of a pair of socks to be secured together. Each housing member is attached to each sock by disposing a layer of material of the sock between the exterior member and interior member and rigidly affixing the exterior member and interior member to one another.

Each exterior member preferably comprises a generally flat casing, a magnetic element, and a covering panel. The casing includes an interior surface with a recess for receiving a first magnetic element and a second covering panel. Each casing of each exterior member further includes an outer surface being sized and adapted for cooperatively interlocking with a complimentary outer casing surface of the other housing member. The magnetic element is positioned within each casing. On top of this element is placed the second covering panel that is sized and adapted to overlap the first magnetic element and fit snugly into the recessed interior of the casing.

The interior member preferably includes a generally flat back plate having an interior and exterior surface. The interior surface of each back plate has at least one protuberance for rigidly affixing the interior member to the exterior member through a layer of material disposed therebetween. Preferably, the protuberance has an extended member for forming a snap-fastening arrangement with the exterior member.

In an alternative housing configuration, each exterior member housing member is comprised of two generally flat panels of similar size which encapsulate a zinc-coated magnetic element.

Furthermore, the respective housing members may have a surface for receiving a decorative ornament. Such ornament may include a sporting team logo or a mark of a well known product or service.

It is therefore an object of the present invention to provide a magnetic sock holder that can secure a pair of matching socks in connected condition during washing and handling.

Another object of the present invention is to provide a magnetic sock holder that does not interfere with the normal use and wear of the sock.

Yet another object of the present invention is to provide a magnetic sock holder that has means for displaying a decorative design or mark.

As will be made clear from the drawings presented below, other and still further objects and advantages will be more clearly understood and appreciated by those skilled in this art.

DETAILED DESCRIPTION OF THE PREFERRED EMBODIMENT

Figures 1, 2, 3, 4, 5, 6, 7, 8:
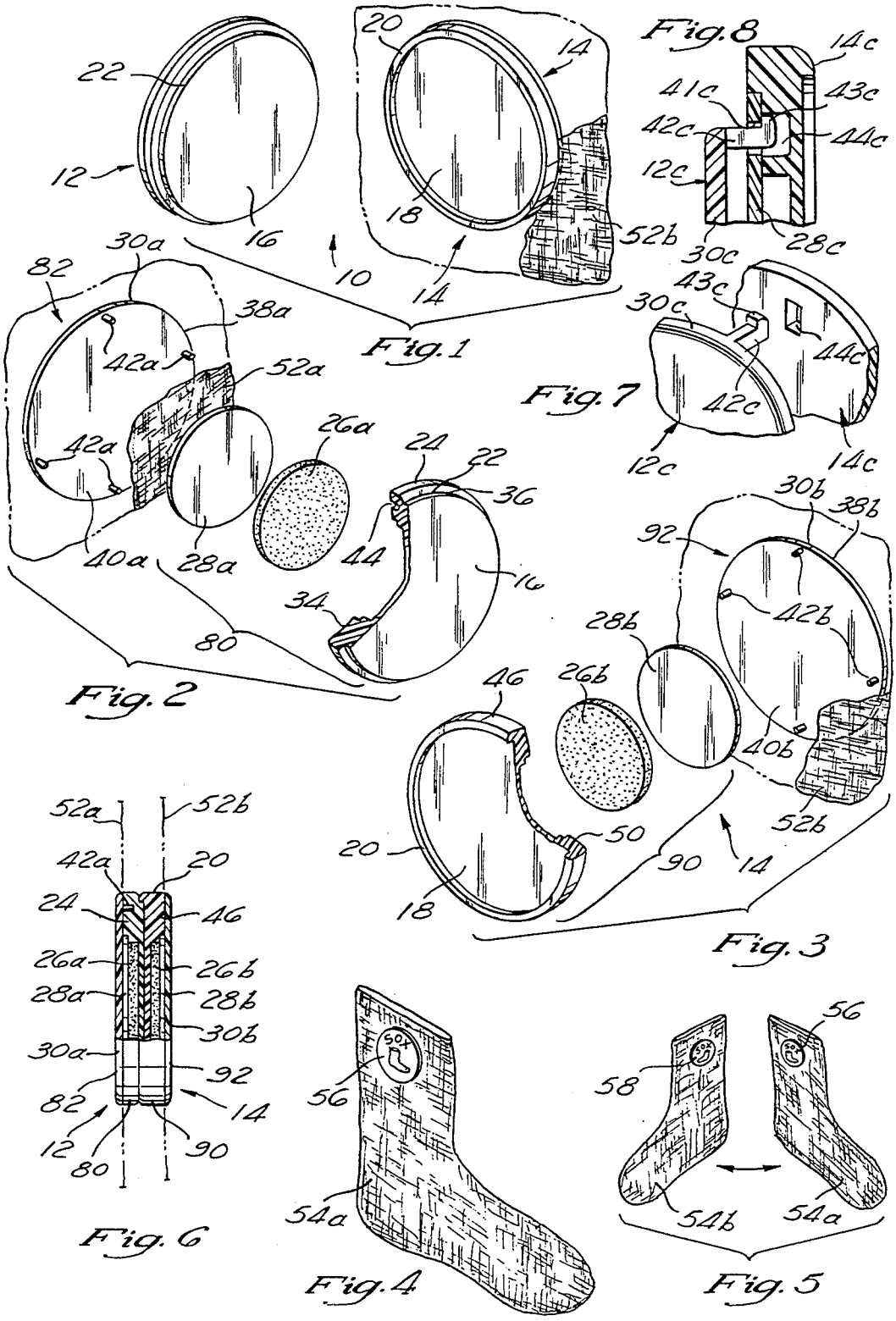
FIG. 1 is a perspective view of a magnetic sock holder according to a preferred embodiment of the present invention.
FIG. 2 is an exploded view of the components of a first housing member of the magnetic sock holder.
FIG. 3 is an exploded view of the components of a second housing member, the second housing member being designed to interconnectably fit with the first housing member of FIG. 2.
FIG. 4 is a perspective view of the magnetic sock holder being utilized to secure a pair of socks in connected condition.
FIG. 5 is a perspective view of a pair of socks having the magnetic sock holder attached thereto.
FIG. 6 is a cross-sectional view of the housing members in an interlocked engagement.
FIG. 7 is a perspective view of a portion of a preferred interior member and a preferred exterior member of a housing member.
FIG. 8 is a cross-sectional view of a portion of a preferred interior member and a preferred exterior member wherein the preferred members are interconnected.

Referring to the drawings, and more particularly to FIG. 1, there is shown a magnetic sock holder 10 embodying the principles of the present invention. The device comprises a pair of detachably interconnectable housing members 12, 14 that are generally flat and may be configured in a variety of shapes, such as a generally circular shape as shown. Furthermore, each housing member is attachable to each respective sock of the pair of socks. An outer surface on each of the housing members 16, 18 is designed to form a snug, complimentary fit with a corresponding outer surface of the other housing member that, in use, resists lateral sliding movement.

As FIG. 1 illustrates, each housing member 12, 14 has structural means for interfitting with the other housing member. In a preferred embodiment, one of the housing members 14 will have an annular lip 20 protruding about the circumference of the housing member 14 whereas the complimentary housing member 12 will have a raised circular portion 22 that is shaped and designed to be received within the cavity created by the circularly extending lip 20. The resulting engagement produces a non-sliding, interlocking configuration. This non-sliding configuration is particularly advantageous in preventing the magnetic sock holder from slipping out of engagement during the laundering process.

In one form of the invention, each housing member is comprised of an interior member and an exterior member, the latter having three separate parts. FIGS. 2 and 3 illustrate the combination of these parts as each part cooperates to form a housing member 12, 14.

Referring particularly to FIG. 2, the respective components of a first housing member 12 are shown. These components include an exterior member 80 and an interior member 82. The exterior member 80 preferably comprises a casing 24, a first magnetic element **26*a*, and a first covering panel 28*a*. The casing 24 has an exterior surface 16 and interior surface 34. The exterior surface 16 preferably has a groove 36 and raised circular portion 22 that are shaped and designed to interconnect with the complimentary second housing 14 depicted in FIG. 3. The interior surface 34 of the casing 24 is shaped and designed to encapsulate the first magnetic element 26*a* and the first covering panel 28*a*. The first magnetic element 26*a* is preferably circular and generally flat so as to form a snug, complimentary fit within the casing 24. The first covering panel 28*a* is placed over the embedded first magnetic panel 26*a* so that the first magnetic element 26*a* becomes completely encapsulated. The first covering panel 28*a* should likewise be generally flat and circular and should be sized and adapted to form a snug, water-tight fit with the interior surface 34 of the casing 24 once the first magnetic element 26*a* has been positioned within the casing 24**.

The interior member 82 preferably comprises a generally flat back plate **30*a*. The back plate 30*a* has an exterior surface 38*a* and interior surface 40*a*, the latter having at least one protuberance 42*a* to attach to the external member 80. The housing member is attached to the sock by rigidly affixing the interior member to the exterior member while a layer of material from the sock 52*a* is disposed therebetween. Accordingly, the interior surface 40*a* of the back plate 30*a* is placed over the embedded first magnetic element 26*a* and first covering panel 28*a* as the first magnetic element 26*a* and first covering panel 28*a* are received within the casing 24. The protuberances 42*a* located on the interior surface of the back plate 30*a* should extend through the layer of material 52*a* so that the protuberances 42*a* may come into contact with the exterior member 80. The back plate 30*a* may then be attached by sonically welding one or more protuberances 42*a* to the interior surface 34 of the casing 24. Alternatively, these protuberances 42*a* may be received within notches 44 located within the interior surface 34 of the casing 24 so as to securely lock the back plate 30*a* to the casing 24**.

FIG. 7 depicts another form of the invention wherein **44*c* the protuberances 42*c* of the back plate 30*c* and the notches of the interior surface of the casing 24*c* are designed to interconnect the interior member 12*c* and exterior member 14*c* through a snap-fastening arrangement. As illustrated, the protuberance 42*c* has an extended fastening member 43*c* for engaging with the notch 44*c*. The notch 44*c* is shaped to receive the protuberance 44*c* and extended fastening member 43*c* so that the exterior member 14*c* and interior member 12*c*** may be manually affixed to a sock.

FIG. 8 further illustrates this preferred snap-fastening arrangement between the interior member 12c and the exterior member **14*c*. As shown, the protuberance 42*c* with extended fastening member 43*c* become securely received within the notch 44*c*. Preferably, the protuberance 42 with extended fastening member 43*c* is located at the outer-most edge of the back plate 30*c*. Additionally, the back plate 30*c* and protuberance 42*c* with extended fastening member 43*c* are sized and shaped to allow the protuberance 42*c* with extended fastening member 43*c* to pass through an aperture 41*c* formed on the covering panel 28*c* of the exterior member 14*c***.

As mentioned above, the interior member 82 that is incorporated in each of the embodiments is comprised of a generally flat back plate. The back plate is affixed and oriented so that the exterior surface **38*a***, which is preferably smooth, comes into contact with the skin of the wearer. This shape and orientation is particularly advantageous for providing means to attach the sock to the housing member while not interfering with the comfort or fit of the sock while the sock is worn.

Referring to FIG. 3, a complimentary second housing 14 of substantially similar construction is shown. Accordingly, the housing member has an exterior member 90 and interior member 92. With respect to the exterior member 90, a second casing 46 is shown having an interior surface 50 and exterior surface 18, the exterior surface 18 being designed to form an interlocking, slide-resistant engagement with the complimentary outer casing surface 16 of the first housing member 12. As illustrated, an annular lip 20 is shown extending about the circumference of the casing 46. As mentioned above, the lip 20 provides means for preventing lateral movement between the housing members when the members are cooperatively interconnected. Also shown are the second magnetic element **26*b* and second covering panel 28*b* that are to be received within the second casing 14, respectively. Also depicted is the interior member 92 comprised of a back plate 30*b* having protuberances 42*b*, wherein the protuberances are positioned for attachment to the interior surface 50 of the casing 46 through a layer of material 52*b* disposed therebetween. Accordingly, the interior member 92 may be attached to the exterior member 90** by any of the aforementioned methods.

In an alternative housing configuration (not shown), each exterior member of each housing member comprises a magnetic element encapsulated in an envelope formed by two panels of substantially similar size that are fastened together. The panel of magnetic material is zinc coated so as to minimize corrosion of the magnetic material during the laundering process. Once the coated magnetic element is received within the envelope, the interior member may be fastened to the exterior member and attached to the sock in any such manner as discussed above.

Referring to FIG. 6, a cross-sectional view of the housing members 12, 14 is shown wherein the housing members 12, 14 are in complimentary interlocking engagement. The exterior members 80, 90 are in direct contact with one another with the rigidly attached interior members 82, 92 facing in oppositely opposing directions. Sandwiched between each exterior member and interior member is a layer of material from each respective sock 52*a*, 52*b*. The exterior members 80, 90, through magnetic attraction and complimentary interconnecting surfaces, cause the pair of socks to remain in connected condition throughout the laundering process. Preferably the interconnecting surfaces have structural means, such as the annular lip 20 shown, that prevent any lateral sliding movement between the housing members 12, 14.

FIG. 4 depicts a respective one of a pair of socks 54 having a housing member attached thereto. In a preferred embodiment, the exterior member will have a surface 56 for receiving a hot-stamped or pad-printed design, such as a sporting-team logo as shown.

FIG. 5 shows in perspective the housing members of the magnetic sock holder in a disengaged state. As illustrated, each housing member is individually attached to each respective one of a pair of socks 54*a*, 54*b*. Each housing member 56, 58 is attached by disposing a layer of material from a sock between the exterior member and interior member prior to the fastening of the interior member to the exterior member. To engage the apparatus, and thus secure the paired items in connectable condition, the cooperatively interconnecting surfaces of each housing member 56, 58 need only be directly contacted. Once the pair of socks 54*a*, 54*b* have been sufficiently connected, the connected items may be laundered and handled as a single unit. Essentially, the non-slidable interlocking engagement and force of magnetic attraction cause the pair of socks 54*a*, 54*b* to remain in such configuration until the user disengages the housings 12, 14 after the laundering process. Upon completion of the laundering process, the magnetic sock holder can be easily disengaged through manual pulling.

There has thus been provided a magnetic sock holder suitable for keeping a pair of socks in connected condition throughout normal laundering and handling procedures.

It should be understood that various modifications within the scope of this invention can be made by one of ordinary skill in the art without departing from the spirit thereof. We therefore wish our invention to be defined by the scope of the appended claims as broadly as the art will permit, and in view of the specification if need be.

What is claimed is:

1. An apparatus for securing a pair of socks in connected condition during handling and laundering comprising:

a first housing member having a magnetic interior and at least one exterior surface for detachably engaging an interconnectable surface on a second housing, the first housing member being attachable to a first respective one of a pair of socks;

a second housing member having a magnetic interior and at least one exterior surface for detachably engaging the interconnectable surface of the first housing member, the second housing member being attachable to a second respective one of a pair of socks, wherein the cooperative interconnecting of the housing members creates a magnetic attraction sufficient to withstand separation of the members when acted upon by forces common to routine handling and laundering;

wherein each housing member has an interior member and an exterior member, said exterior member comprising:

a) a generally flat casing having an exterior surface and interior surface, the exterior surface being sized and adapted for cooperatively interconnecting with a complimentary outer casing surface of the other housing members, the interior surface having at least one notch and a recess, the recess being sized and adapted to receive a magnetic element and an overlapping covering panel, the at least one notch being sized and adapted to interlock with at least one protuberance on the interior member;

b) an element of magnetic material, the magnetic element being embedded within the portion of the recess of the casing adapted to receive the magnetic element; and c) a covering panel, the covering panel being shaped and oriented to substantially overlap the magnetic element and form a snug, water-tight fit with the portion of the recess of the casing adapted to receive the covering panel.

2. The apparatus of claim 1 wherein the at least one protuberance and the at least one notch form a snap-fastening arrangement, said at least one protuberance having an extended member, said at least one notch being shaped to receive the at least one protuberance having the extended member.

3. The apparatus of claim 1 wherein at least one of the housings has a surface for receiving an ornamental design.

* * * * *